United States Patent [19]

Mills et al.

[11] 3,990,340

[45] Nov. 9, 1976

[54] VALVE DEVICE ESPECIALLY FOR PNEUMATICALLY OPERATED PLAYER PIANOS AND ORGANS

[75] Inventors: Richard R. Mills, Otwell; Richard Hebeisen, Jasper, both of Ind.

[73] Assignee: Kimball International, Inc., Jasper, Ind.

[22] Filed: June 4, 1975

[21] Appl. No.: 583,643

[52] U.S. Cl. ..... 84/60; 84/62; 84/64; 251/61.2

[51] Int. Cl.[2] ..... G10F 1/02

[58] Field of Search ..... 84/50–64; 251/61, 61.1, 61.2

[56] References Cited

UNITED STATES PATENTS

| | | | |
|---|---|---|---|
| 814,677 | 3/1906 | Doman | 84/60 X |
| 901,929 | 10/1908 | Wood | 84/62 X |
| 1,053,936 | 2/1913 | Van Valkenburg | 84/62 |
| 1,064,575 | 6/1913 | Waite | 84/59 |
| 1,188,716 | 6/1916 | Beitel | 84/63 X |
| 1,219,104 | 3/1917 | Jameson | 84/60 X |
| 1,246,096 | 11/1917 | Hiscock | 84/60 X |
| 1,536,150 | 5/1925 | Schnell | 84/51 X |
| 1,652,963 | 12/1927 | Walker | 84/60 X |
| 3,033,068 | 5/1962 | Westfield | 84/60 X |
| 3,336,843 | 8/1967 | Griswold | 251/61 X |
| 3,499,368 | 3/1970 | Ballantine | 84/51 X |

*Primary Examiner*—Lawrence R. Franklin
*Attorney, Agent, or Firm*—Melvin A. Crosby

[57] ABSTRACT

A valve device, especially for pneumatically operated pianos and organs, in which the valve device is interposed between a source of suction and pneumatic actuators for the keys of the instrument and under the control of a perforated paper strip. The valve of the present invention is particularly characterized in being readily disassembled for adjustment and service and replacement of parts if necessary.

6 Claims, 5 Drawing Figures

VALVE DEVICE ESPECIALLY FOR PNEUMATICALLY OPERATED PLAYER PIANOS AND ORGANS

The present invention relates to a valve device, especially for use with player pianos and organs and the like, and is particularly concerned with a valve device of the aforesaid nature which can readily be disassembled for adjustment of service or repair and including replacement of parts.

Player pianos and organs of the pneumatically operated type have a source of suction and valves interposed between the source of suction and pneumatic actuators for the keys of the instruments with the individual valves being under the control of a perforated paper sheet which runs over a tracker bar having holes connected with control ports of the respective valves.

In an arrangement of this nature, while a hole is covered by the paper sheet, the valve remains closed and the respective key remains in unactuated position. When, however, a perforation in the paper sheet moves over a hole in the tracker bar pertaining to a respective valve, air is admitted to the control port of the valve and a valve member in the valve moves thereby admitting suction to the pneumatic actuator for the respective key resulting in actuation of the key. When the perforation moves off the respective hole in the tracker bar, the valve again closes and the pneumatic actuator for the key relaxes and the key returns to nonactuated positions.

Valves of the aforesaid nature are well known and have been used for a long time. For example, a valve which will carry out the functions referred to it illustrated in detail in the M. A. Slaats, et. al., U.S. Pat. No. 3,474,110 and which is assigned to the same assignee as the instant application. The Slaats, et. al., valve, however, as well as other valves according to the prior art, are constructed of various elements which include generally flat body parts and the body parts are then cemented permanently together so that no possibility presents itself of adjusting or repairing the valve after it has been manufactured.

Furthermore, in the prior art, it was common to assemble two valves in one valve body so that a failure of one valve meant that two valves had to be replaced.

With the foregoing in mind, a primary objective of the present invention is the provision of an improved valve of the nature referred to in which each valve is independent of very other valve and in which the individual valves can readily be disassembled for service, including replacement of parts thereof.

It is also an object to provide a valve of the nature referred to which is inexpensive to manufacture but which is highly efficient in operation.

BRIEF SUMMARY OF THE INVENTION

According to the present invention, a valve is provided which comprises a cup-like member with a downwardly opening rim adapted for sealingly engaging a rubber-like gasket beneath the valve. Disposed in the valve body from beneath is a base portion. A thin flexible diaphragm is disposed in the recess and the periphery thereof is clamped between the inner end of the base portion and a shoulder in the recess. The diaphragm serves as a valve member actuator. The base portion also sealingly engages the aforementioned gasket. A sealing ring between the valve body and the base portion seals about the periphery of the diaphragm referred to.

The valve member consists of a rubber-like poppet member and a stem dependent therefrom and adapted for engagement by the upper side of the diaphragm. In one position of the diaphragm, it is flexed downwardly and permits the valve member to rest on a seat which is interposed between first and second chambers in the valve body. The first chamber is subject to suction and continuously communicates with the upper side of the diaphragm whereas the second chamber communicates with the pneumatic key operator.

When the diaphragm is flexed downwardly, and the valve member is resting on the aforementioned seat, the second chamber communicates with the atmosphere via a port in the top of the valve body and through a felt or foam filter member engaging the top of the valve body and also serving as the clamp medium for clamping the valve body in place.

When, however, the diaphragm flexes upwardly, the valve member is moved upwardly thereby and closes the port in the top of the valve body while connecting the first and second chambers so that the suction standing in the first chamber will now be applied to the second chamber and therefrom to the pneumatic actuator for the key and thereby cause actuation of the respective key.

A bleed hole in the diaphragm communicates the suction chamber above the diaphragm with the space below the diaphragm and the last mentioned space is connected to a respective hole in a tracker bar by suitable tubing.

Due to the bleed port in the diaphragm, when the hole in the tracker bar is covered, the diaphragm flexes downwardly and the respective pneumatic operator is under atmospheric pressure and is relaxed and the respective key is in nonactuated position. When, however, the respective tracker bar hole is uncovered so that air can flow therein, the suction beneath the diaphragm is relieved and the suction above the diaphragm pulls it upwardly thereby lifting the valve member upwardly to close the exhaust port in the top of the valve while connecting the suction chamber above the diaphragm to the respective pneumatic key operator and causing actuation of the respective key.

The various parts of the valve are selected and sized to provide for the proper action of the valves to obtain the proper response to the uncovering of a port in the tracker bar and all of the valves are substantially identical so that the time of operation of each is the same as the time of operation of all the others as the respective tracker bar holes are uncovered and then again covered.

The exact nature of the present invention will become more apparent upon reference to the following detailed specification taken in connection with the accompanying drawings in which.

DETAILED DESCRIPTION OF THE INVENTION

Figure 1:
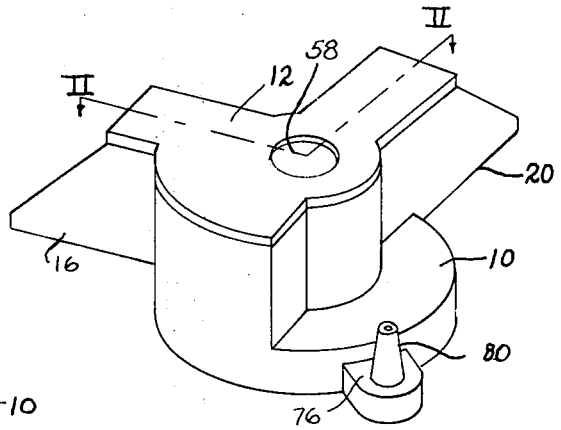
FIG. 1 is a perspective view of a valve according to the present invention.
Figure 2:
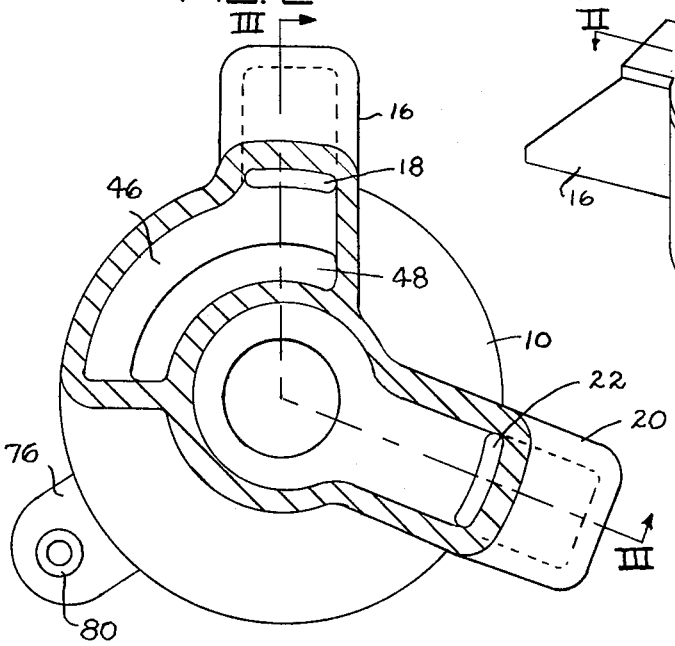
FIG. 2 is a plan section indicated by line II—II on FIG. 1.
Figure 2:
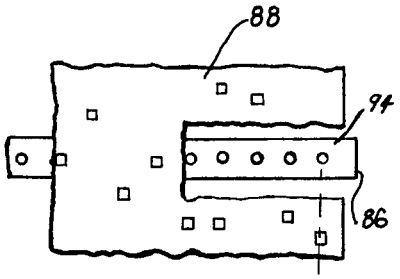
Figure 3:
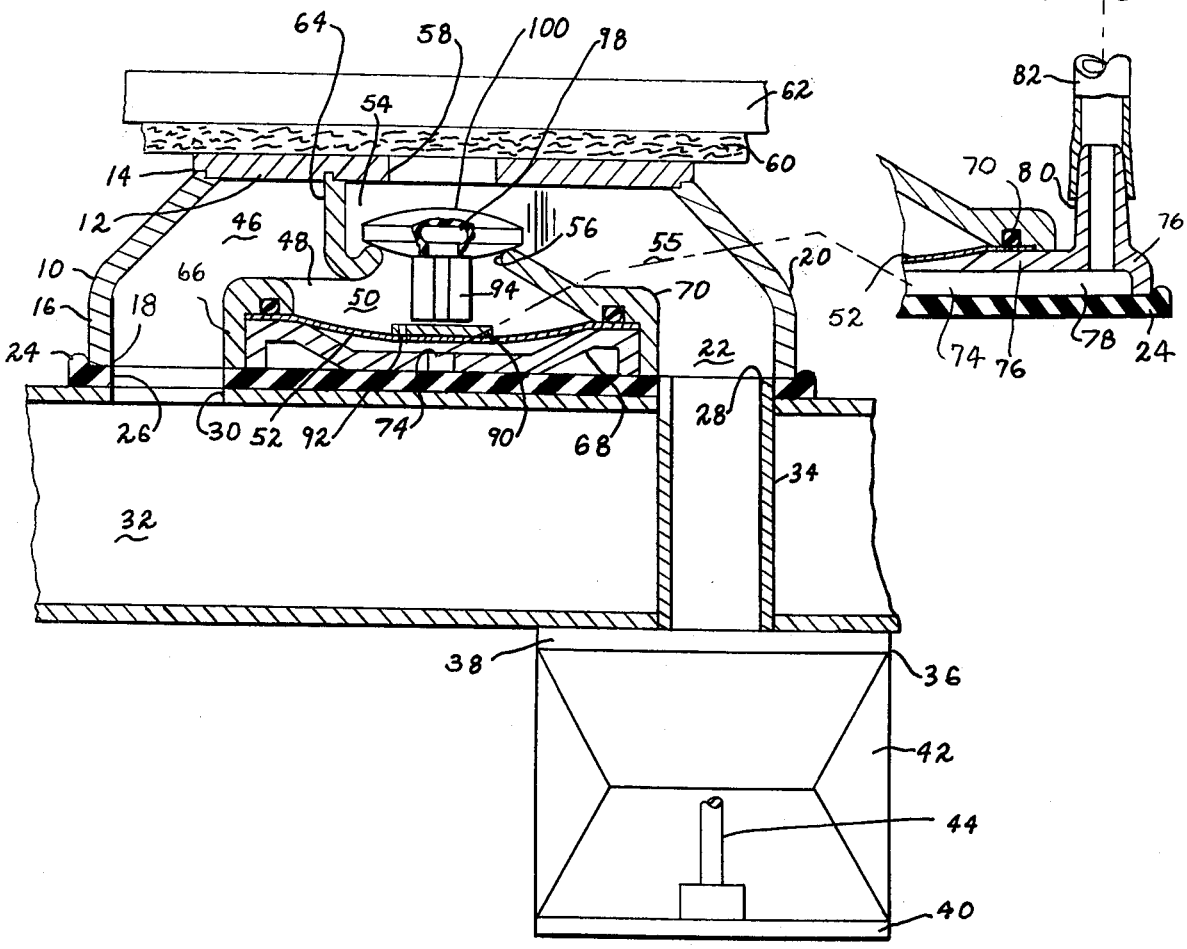
FIG. 3 is an irregular section through the valve as indicated by line III—III on FIG. 1.

Referring to the drawings somewhat more in detail, and with particular reference to FIGS. 1 to 3, the valve according to the present invention comprises a generally tubular, somewhat cup shaped, main body part 10 which is a molded member, preferably of plastic, and the open top of which is closed by a cover plate 12 cemented or welded to the upstanding rim of the body part as at 14. The body part, as will be seen hereinafter, is divided internally into a pair of chambers which communicate via a hole, or port surrounded by a valve seat.

Main body part 10 has a laterally projecting portion 16 defined a downwardly opening suction port 18 and a second laterally extending portion 20 defining another downwardly opening service port 22. The valve body is mounted on a resilient rubber-like gasket member 24 which extends completely across the bottom of the valve body and includes a hole, or port, 26 registering with port 18 of the valve body and a hole, or port, 28 registering with port 22 of the valve body.

Hole 26 communicates with a further hole 30 provided in one wall of a suction box 32 which is maintained under a predetermined suction as will be explained hereinafter. Hole 28 on the other hand has a tube 34 connected thereto that extends downwardly completely through the suction box 32 and communicates with the pneumatic key actuator 36. The pneumatic actuator is a well known item and comprises a top plate 38 attached to the bottom of the suction box and another plate 40 hinged at one end to plate 38.

A flexible material at 42 which may, for example, be leather or foam, flexibly connects the plates so that when suction is supplied to the pneumatic actuator via tube 34, plate 40 will be drawn upwardly and thereby lift a key actuator rod 44 which is connected to, or abuttingly engages, plate 40 and thereby actuate a respective key. When tube 34 is relieved of suction, plate 40 again drops downwardly and rod 44 will also drop downwardly and release the actuated key.

The suction port 18, as will best be seen in FIG. 2, communicates with a first, suction, chamber 46 in the valve body which extends arcuately a distance somewhat greater than 90° and the bottom wall of which has an arcuate port 48 formed therein by means of which chamber 46 communicates with a space 50 in the valve body located above a flexible leather-like diaphragm member 52.

Port 22 on the other hand communicates via passage 55 with a second, service chamber 54 which, as will best be seen in FIG. 2, is concentric with the central axis of the valve and readily inwardly from suction chamber 46. A first circular port 56 surrounded by a valve seat is formed in the valve body at the center of chamber 54 and in the top thereof and connects chambers 46 and 54. Directly opposed to port 56 in a second port 58 in the cover plate 12 of the valve body and which communicates with the atmosphere via felt pad 60 which is held down by clamp bar 62.

It will be noted that the chamber 54 in the region thereof in which the aforementioned first port 56 and second port 58 are disposed is surrounded by a wall portion 64 of the valve body. Wall portion 64 separates chambers 46 and 54 from one another.

Cover plate 12 may be, as mentioned, cemented or welded in place on the valve body, and it has been found that ultrasonic welding is suitable for this purpose when the valve body and the top plate 12 are formed, for example, of natural polypropylene or a similar material.

The valve body includes a substantially circular downwardly extending wall portion terminating in a rim 66 and defining a downwardly opening central cavity in the valve body in which a valve base member 68 is disposed. Between the upper peripheral edge of base member 68 and a downwardly facing shoulder formed near the top of wall 66 there is clamped the periphery of diaphragm 52 with at least one of the shoulders being provided with a groove in which a resilient O-ring 70 is mounted and which sealingly engages the diaphragm and provides for a tight fluid seal about the diaphragm at the periphery thereof.

The base member 68 has a slot or conduit 74 formed therein and extending along a portion 76 of the base member which protrudes outwardly from the side of the valve body as will be seen in FIGS. 1 and 3. Slot 74 is closed across the top from radially inwardly of seal ring 70 outwardly to externally of the valve body as indicated at 78 in FIG. 3 and communicates via a nipple portion 80 with a tube 82 that leads to a respective hole or port 84 in a tracker bar 86. Tracker bar 86 is adapted for having a perforated music roll 88 moved thereacross.

Music roll 88 is maintained in a predetermined position of lateral alignment on tracker bar 86 so that one longitudinal series of perforations therein will register with hole 84 in predetermined advanced positions of the paper roll. The reason for this will be explained subsequently.

Diaphragm 52 has a disc 90 cemented to the top thereof to stiffen the central portion of the diaphragm and a bleed hole 92 is formed through the diaphragm, preferably within the range of the disc 90, and extending through the disc. A light weight stem element 94, which may be a plastic molding somewhat cruciform shaped in cross section is provided extending axially through port 56. The lower end of stem element 94 rests on or near the upper side of disc 90 when the diaphragm is flexed downwardly, while the upper end is provided with a button-like projection 98 that is receivable in a hole formed into the lower side of a rubber-like poppet valve member, or disc, 100. Valve member 100 in its FIG. 3 position, sealingly engages port 56 while in an upper position, indicated in dashed outlines in FIG. 3, sealingly engages port 58.

The stem slides freely in port 56 while holding the valve member 100 in coaxial relation with ports 56 and 58. The valve member is preferably a soft rubber-like material which enhances the effectiveness of the sealing engagement of the valve member with ports 56 and 58.

After removing base member 68 and diaphragm 52, stem element 94 can be detached from valve member 100 and the valve member can then be pushed out of the valve body through port 56 by somewhat deforming the valve member. The valve member 100 is, however, as mentioned, made of soft rubber-like material and can be deformed to the extent necessary to pass it through port 56 without damage to the valve member.

Figure 4:
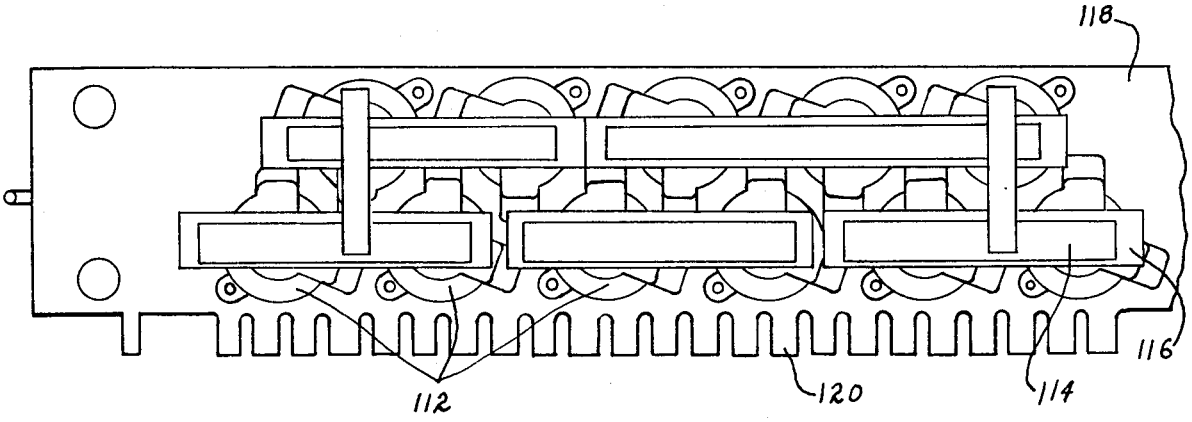
FIG. 4 is a fragmentary plan view showing how groups of the valves can be assembled in a piano case.
Figure 5:
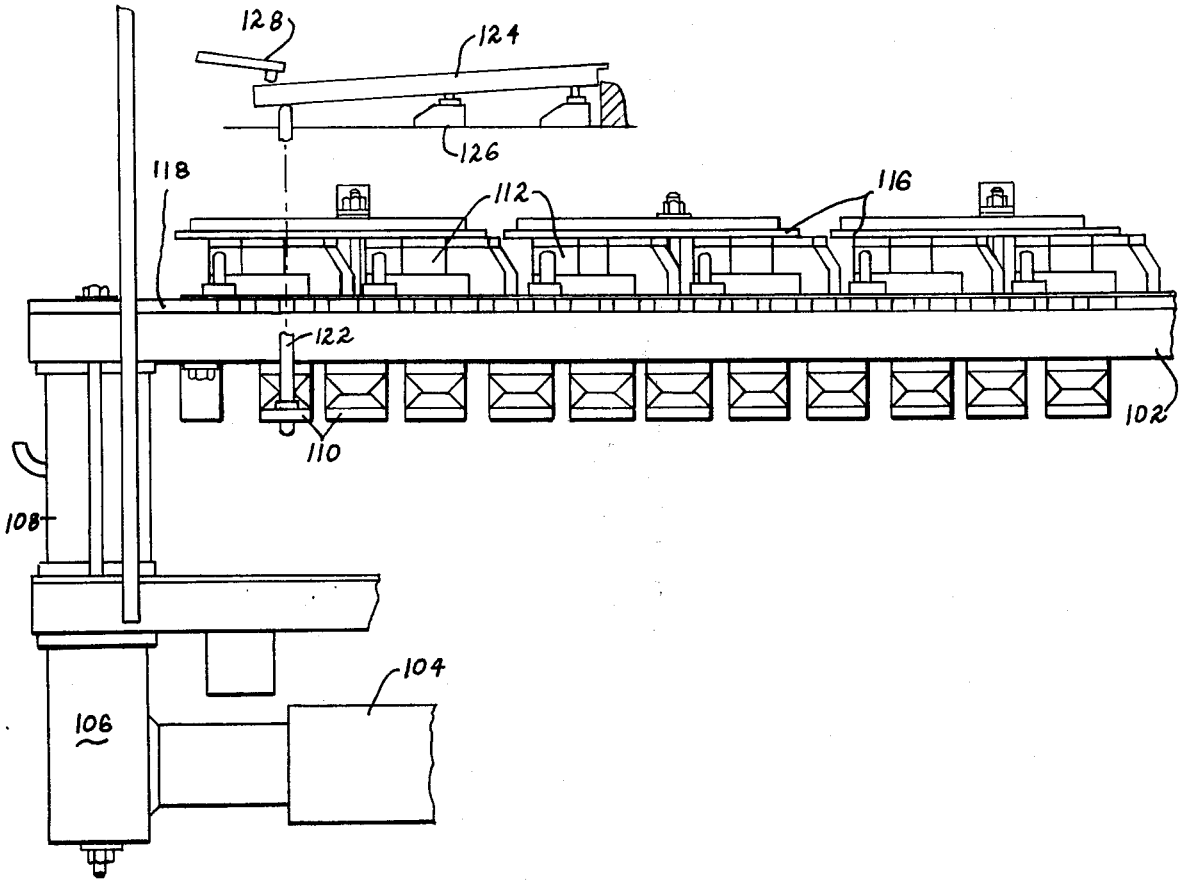
FIG. 5 is a view looking in at the front of the assembly of FIG. 4 and also showing schematically the connection between one of the pneumatic operators and the respective key.

FIGS. 4 and 5 show one manner in which valves according to the present invention can be mounted in a piano case. In FIGS. 4 and 5, a suction box common to the valves illustrated is designated at 102 and is adapted for being supplied with suction from source 104 via the chests or chambers 106 and 108. The suction box 102 may have support plate members connected to the top and bottom thereof which are availed of for supporting the valves and the pneumatic actuators controlled thereby according to the present invention.

In FIG. 5, the pneumatic actuators are generally indicated at 110 and are under the control of respective ones of the valves mounted on top of the suction box indicated at 112 in FIGS. 4 and 5.

Since the valves are individual structures, they can be positioned on top of the suction box in rotated position to place the ports thereof which communicate with the respective pneumatic operators and the ports which communicate with the suction box in the most advantageous positions. The valves are clamped down in groups by clamp elements 114 and between which clamp elements and the tops of the valves are interposed the aforementioned felt filter elements 116.

The plate 118 on which the valves rest may have a comb-like edge 120, the notches of which can be employed for guiding the rods 122 which are associated with the respective pneumatic actuators.

As will be seen in FIG. 5, each rod 122 at its upper end engages the underside of the rear end of a respective key 124 and which key is tiltably mounted in the piano case as on the tilt block 126 and with the rear end of the key having associated therewith a respective portion 128 of the action, in this particular case, a portion of a piano action, while in the case of a player organ of the electronic type, portion 120 would be in the form of an actuator member for switch means.

Generally, a pair of suction boxes in superposed relation are provided to carry all of the valves and pneumatic actuators required for a keyboard. The spacing between the valves and actuators in FIGS. 4 and 5 will accommodate alternate keys and a suction box at a lower level with actuators and valves will be provided to accommodate the other keys of the keyboard.

OPERATION

In operation, the valve is disposed as illustrated in FIG. 4 with the axis of the valve body vertical and with the top wall upppermost. The suction which is in the suction box is supplied through the suction chamber to the upper side of the diaphragm and through the hole or bleed port in the diaphragm to the underside of the diaphragm. If the control port is closed, the suction on the underside of the diaphragm together with the weight of the valve member and stem will cause the diaphragm to flex downwardly and the valve member, or disc, will seat on the port interconnecting the suciton chamber with the service chamber, while simultaneously connecting the service chamber to the atmosphere.

Under these conditions, the pneumatic actuator connected to the service chamber is under atmospheric pressure and relaxes and permits the key actuating rod associated therewith to move downwardly leaving the respective key in non-actuated position.

If, now, the control port is connected to the atmosphere by a perforation in the music roll moving across the tracker bar uncovering the pertaining hole in the tracker bar, the suction beneath the diaphragm is relieved and the diaphragm will flex upwardly. The hole, or bleed port, in the diaphragm is not sufficiently large to offset the increase in pressure under the diaphragm due to air coming in through the control port.

When the diaphragm flexes upwardly it moves the stem and valve disc upwardly, thereby opening the port between the suction chamber and the service chamber, while simultaneously closing off the port between the suction chamber and the atmosphere. The suction in the suction chamber is now transmitted through the service chamber to the pneumatic actuator and the actuator is thereby collapsed and lifts the rod associated therewith and actuates the respective key. When the hole in the tracker bar is again covered by the music roll, the first mentioned conditions are restored and the key moves back to non-actuated position.

Modifications may be made within the scope of the appended claims.

What is claimed is:

1. In a valve for controlling the application of suction to the pneumatic actuator for a key of a musical instrument; a valve body having a first suction chamber therein and a second chamber therein overlying said first chamber, a first port connecting said first chamber to a source of suction and a second port connecting said second chamber to the respective pneumatic, a generally horizontal wall in the valve body separating said chambers from one another, a third port formed in said wall interconnecting said chambers and a valve member movable in the second chamber for opening and closing said third port, said valve body having a generally horizontal top wall with a hole therein aligned with and about the same size as said third port and communicating with said second chamber, said valve member being formed of resilient material and being removable from said valve body via one of said third port and said hole, a diaphragm in the valve body closing said first chamber from below and operable when flexed upwardly to move said valve member upwardly to open said third port to connect said chambers while closing said hole to interrupt communication between said second chamber and the atmosphere, a bleed passage connecting said first chamber with the space beneath said diaphragm, a recess extending into the valve body from below having a downwardly facing shoulder near the bottom and in which recess the diaphragm is disposed, a base member removably fitted into said recess and having an upwardly facing shoulder at the upper end facing the shoulder in the recess, the peripheral portion of the diaphragm being sealingly clamped between said shoulders, and means controlling communication between said space and the atmosphere.

2. A valve according to claim 1 in which said valve member comprises a disc element between said horizontal wall and said top wall, and a stem thereon extending axially through said first hole to the axial region of said diaphragm.

3. A valve according to claim 1 in which said means controlling communication between said space and the atmosphere includes a conduit leading from externally of said valve body into said space beneath the diaphragm and terminating in a control port at the end outside the valve body, and control means for selectively opening and closing said control port.

4. A valve according to claim 1 in which said valve body has a top wall and a peripheral wall and a planar bottom rim region, said recess being cylindrical and extending into the bottom of said body on the central axis of the body, said base member having the end opposite the shoulder end coplanar with said bottom rim region of the valve body when the diaphragm is clamped between the said shoulders, said first and second ports opening through the bottom of the valve body radially outwardly from said recess, and a resilient gasket member sealingly engaging the bottom rim region of the valve body against which the valve body is clamped and having holes registering with said ports.

5. A valve according to claim 1 which includes a stem detachably connected to said valve member and extending through said third port to the axial region of said diaphragm.

6. A valve according to claim 1 in which said valve body is a generally tubular molded plastic member having wall means therein separating said chambers from one another, said valve body having upper and lower planar rim regions, said upper rim region comprising the upper edges of said peripheral wall and said wall means, and said top wall comprising a generally flat plastic member sealed to said upper rim region, said first and second ports opening downwardly through the bottom of the valve body, a resilient gasket on the bottom of the valve body having holes registering with said first and second ports, a porous filter element overlying the hole in said top wall, a clamp element engaging the filter element and clamping the filter element against said top wall while clamping the valve body against said gasket, a suction box on which the gasket is mounted having a port registering with the hole in said gasket which registers with said first port, and a tube extending through said suction box and communicating via the other hole in said gasket with said second port.

* * * * *